US010002512B2

(12) United States Patent
Yin

(10) Patent No.: US 10,002,512 B2
(45) Date of Patent: Jun. 19, 2018

(54) SYSTEM AND METHOD FOR OBJECT ENTRY AND EGRESS CONTROL IN A PREDEFINED AREA

(71) Applicant: Le-Jun Yin, Harleysville, PA (US)

(72) Inventor: Le-Jun Yin, Harleysville, PA (US)

( * ) Notice: Subject to any disclaimer, the term of this patent is extended or adjusted under 35 U.S.C. 154(b) by 662 days.

(21) Appl. No.: 14/168,262

(22) Filed: Jan. 30, 2014

(65) Prior Publication Data

US 2015/0213067 A1 Jul. 30, 2015

(51) Int. Cl.
*G08B 21/02* (2006.01)
*G08B 13/14* (2006.01)

(52) U.S. Cl.
CPC ..... *G08B 21/0261* (2013.01); *G08B 13/1427* (2013.01); *G08B 21/0222* (2013.01)

(58) Field of Classification Search
CPC ..... G06F 17/30067
USPC ..... 707/812
See application file for complete search history.

(56) References Cited

U.S. PATENT DOCUMENTS 5,481,613 A 1/1996 Ford et al.
5,886,634 A 3/1999 Muhme
6,025,780 A 2/2000 Bowers et al.
6,809,645 B1 10/2004 Mason
6,842,106 B2 1/2005 Hughes et al.
7,548,152 B2 6/2009 Hillier
7,791,451 B2 9/2010 Lei et al.
7,920,063 B2 4/2011 Ulrich
8,049,594 B1 11/2011 Baranowski
8,332,628 B2 12/2012 Pang et al.
2002/0019943 A1* 2/2002 Cho ..... G06F 21/10 726/27
2002/0087867 A1 7/2002 Oberle et al.
2004/0085207 A1* 5/2004 Kreiner ..... G06Q 10/087 340/572.1
2004/0113786 A1* 6/2004 Maloney ..... G07C 9/00103 340/568.1
2004/0222878 A1 11/2004 Juels
2006/0022794 A1 2/2006 Determan et al.
2009/0169019 A1* 7/2009 Bauchot ..... G06F 21/10 380/278
2009/0212936 A1* 8/2009 Granatelli ..... G05B 23/0262 340/506
2010/0011211 A1 1/2010 Anemikos et al.
2010/0022217 A1 1/2010 Ketari
2011/0215926 A1 9/2011 Goldenberg
2012/0038456 A1 2/2012 Pikkarainen et al.
(Continued)

*Primary Examiner* — Boris Gorney
*Assistant Examiner* — Allen Lin
(74) *Attorney, Agent, or Firm* — Buchanan Ingersoll & Rooney PC

(57) ABSTRACT

A system and method of loss prevention using a pair of ID tags is disclosed. The user or owner of the protected object can dynamically create a security perimeter by using key ID tag and object ID tag pair. An object ID tag is either embedded in or attached to a protected object. A key ID tag, which is in a handheld device, has protection to prevent unauthorized scan. The object ID tag information can only be obtained from key ID tag using preprogrammed algorithm. The area security system will be armed after reading and validating a key ID tag scanned by the user. If anyone takes protected object with object ID tag out of the area without proper key ID tag authentication, alarm will be triggered.

21 Claims, 10 Drawing Sheets

(56) References Cited

U.S. PATENT DOCUMENTS

2012/0131252 A1* 5/2012 Rau ..... H04L 45/60
710/308
2013/0126601 A1* 5/2013 Lee ..... G06F 17/30879
235/375

* cited by examiner

SYSTEM AND METHOD FOR OBJECT ENTRY AND EGRESS CONTROL IN A PREDEFINED AREA

BACKGROUND

Field

The present disclosure relates generally to methods and systems for detecting entry and egress, particularly unauthorized egress, of objects from a predefined area with managed entry and exit points.

Description of the Related Art Object theft or loss costs individuals, retailers, owners of goods, and similar entities billions of dollars a year and can involve serious security breaches, loss of confidential and private information, etc. The costs associated such losses are often passed along to consumers, owners, retailers, original manufacturers and governments. Accordingly, object loss prevention systems are used to reduce instances of product theft or loss.

To deter theft or prevent the movement of items of importance, entities often staff one or more employees at the entrance and/or exits of a location. Guards or other surveillance techniques, such as video cameras, may also be used to deter or discourage such unauthorized movement and/or theft. However, such techniques are expensive, require oversight, and may not be effective in preventing the movement of an item from a specific location, particularly in situations where human observation is a main means of deterrence. Alternatively, retailers, for example, might use RF Identification (RFID) tags secured to products, but this commonly requires logging the objects against the RFID tags, securing and removing the RFID tag at the appropriate times (e.g., at intake of inventory and at sale respectively) and as a practical matter is limited to retail products and inventory or similarly controlled environments. Generally, commonly used RFID tag systems are static "many-to-one" systems wherein many RFID tags, which are either unique or not and attached to products, are associated with a single entity, e.g., retailer or warehouse location. RFID tags are no longer useful once the object leaves the premises.

Privately owned objects such as, for example, computing equipment and electronic devices and other valuable items, may be inadvertently taken or stolen from a custodian's current location without the custodian being aware that such loss took place in time to catch the unauthorized person from taking the object or prevent the loss, particularly if the custodian happens to leave the object unattended in a public or quasi-public space, such as at a library or an airport terminal. The retail version of RFID inventory control would not be practical because of the lack of control over registration of the objects at a given location and over privacy concerns. Therefore, technical problems of existing security systems may result in not adequately protecting valuable items from being removed from a specific area because the technology is not conducive to widespread use where multiple entities might be associated with respective one or more objects in a dynamic "many-to-many" environment. Thus, the present inventor perceives a need for technical solution that provides a more robust and effective object control system.

SUMMARY

Disclosed herein is a method of loss prevention comprising reading, at entrance location of a predetermined area, a key ID tag having a source ID and an algorithm code; calculating, by a central control system, a first calculated target ID based on a source ID and an algorithm code of the key ID tag; storing the first calculated target ID in ID database as an active first calculated target ID; reading, at an exit location of the predetermined area, an object ID tag having an object target ID; comparing, by the central control system, the object target ID to all active calculated target IDs stored in the ID database; and upon determining the object target ID is associated with one of the active calculated target IDs in the ID database, entering a notification state.

The method further includes reading, at an exit location, the key ID tag; and calculating, by the central control system, a second calculated target ID based on the source ID and the algorithm code of the key ID tag; comparing, by the central control system, the second calculated target ID to all active first calculated target IDs stored in the ID database; deactivating that specific first calculated target ID in the ID database upon determining that the second calculated target ID is associated with one of the first calculated target IDs stored in the ID database.

In another preferred embodiment, the method further comprises attaching the object ID tag to a product.

In yet another preferred embodiment, the method further comprises manufacturing a product with the object ID tag embedded in the product.

In still another preferred embodiment, a first ID reader is located at the entrance to the predetermined area, a second ID reader is located at an exit to the predetermined area, and a third ID reader is located at an exit to the predetermined area.

In a further preferred embodiment, the first ID reader is a first Radio Frequency ID ("RFID") or barcode reader, the second ID reader is a second RFID or barcode reader, and the third ID reader is a third RFID or barcode reader.

In yet a further preferred embodiment, the key ID tag is in a secured housing. In still another preferred embodiment, the key ID can be displayed in barcode format (1-D or 2-D) on the screen of a mobile device, such as, smart phone or tablet. In still another preferred embodiment, the key ID tag is in a handheld device with a retractable or removable metal sleeve or cover.

In still a further preferred embodiment, the object ID of an object ID tag further comprises an ID tag type and the key ID of a key ID tag further comprises an ID tag type, the method further comprising determining, via the central control system, whether an ID tag of the plurality of ID tags is the key ID tag or the object ID tag based on a respective ID tag type.

In another preferred embodiment, the database comprises an ID database that stores calculated target IDs and an algorithm database that stores formulas for calculating a calculated target ID.

In yet another preferred embodiment, the object ID of an object ID tag further comprises an object type identifier and further comprising, via central control system, displaying object type information based on the object type identifier.

In still another preferred embodiment, the method further comprises exiting the notification state upon determining that the object target ID is no longer associated with any active calculated target ID in the ID database.

In a further preferred embodiment, the method further comprises manually acknowledging and/or exiting the notification state via a control panel of the central control system.

In yet a further preferred embodiment, the key ID tag has a plurality of source IDs and a plurality of algorithm codes associated with the plurality of object ID tags.

In still a further preferred embodiment, the key ID on a key ID tag comprises a plurality of bits, wherein the plurality of bits comprises a first portion of bits corresponding to an ID type, a second portion of bits corresponding to the algorithm code, and a third portion of bits corresponding to the source ID.

In another preferred embodiment, the object ID on an object ID tag comprises a plurality of bits, wherein the plurality of bits comprises a first portion of bits corresponding to an ID type, a second portion of bits corresponding to an object type, and a third portion of bits corresponding to the object target ID.

Further disclosed herein is a system for detecting an object in a predetermined area that comprises a plurality of ID tags comprising an object ID tag having an object target ID and a key ID tag having a source ID and an algorithm code, an ID reader, and a central control system having a processor and in communication with the ID reader, the central control system being associated with ID database.

The ID reader, at entrance, reads an ID tag of the plurality of ID tags, upon a determination by the central control system that the ID tag that was read by the ID reader is the key ID tag, the central control system calculates a first calculated target ID based on the source ID and the algorithm code of the key ID tag, and the central control system stores the first calculated target ID in the ID database as an active first calculated target ID.

Further, the ID reader, at exit, reads an ID tag of the plurality of ID tags, the central control system calculates a second target ID based on the source ID and the algorithm code of the key ID tag upon a determination by the central control system that the ID tag that was read by the ID reader is the key ID tag, the central control system compares the second calculated target ID to all active first calculated target IDs stored in the ID database, and the central control system deactivates that specific first calculated target ID from the ID database upon a determination by the central control system that the second calculated target ID is associated with one of the first calculated target IDs stored in the ID database.

In addition, the ID reader, at exit, reads the object target ID of an object ID tag, the central control system compares the object target ID read by the ID reader to all active calculated target IDs stored in the ID database, and the central control system enters a notification state upon a determination by the central control system that the object target ID read by the ID reader is associated with one of the active calculated target IDs in the ID database.

In another preferred embodiment, the object ID tag is attached to a product.

In yet another preferred embodiment, the product is merchandise manufactured by a manufacturer, and wherein the merchandise is manufactured with the object ID tag embedded in the merchandise.

In still another preferred embodiment, the object ID further comprises an object type identifier and wherein the central control system uses a display to display an object type information based on the object type identifier.

In a further preferred embodiment, the system further comprises a control panel that is configured to allow for the manual acknowledgement and/or exit of the notification state.

BRIEF DESCRIPTION OF THE FIGURES

In the accompanying drawings, shown are certain present preferred embodiments of the loss prevention and theft deterrence method and system of the present disclosure in which.

DESCRIPTION OF THE PREFERRED EMBODIMENTS

Figure 1:
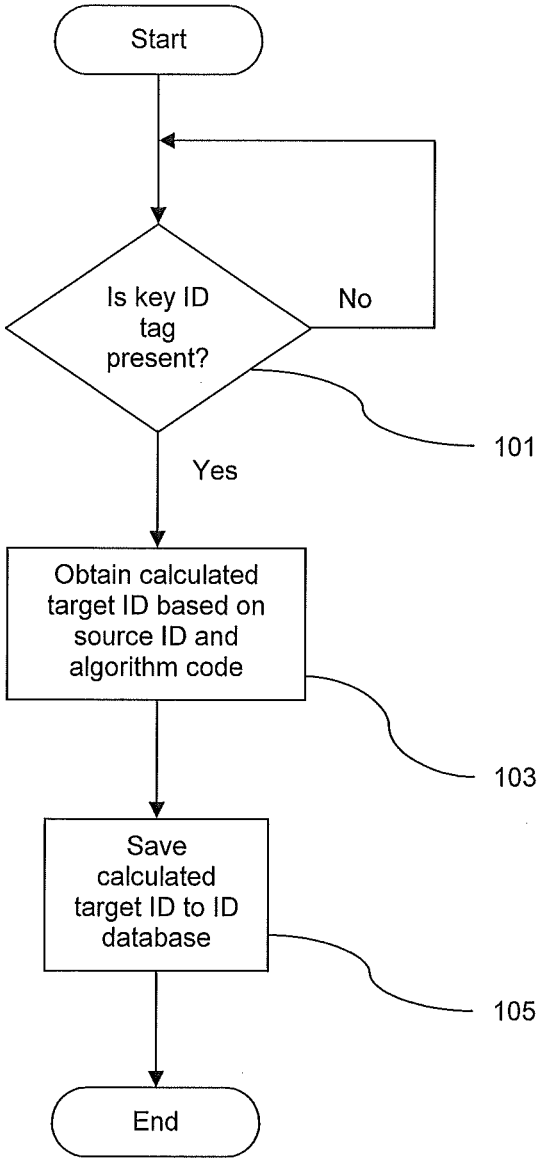
FIG. 1 is a flowchart depicting steps of a preferred embodiment of the present disclosure relating to registering an object upon entering a predetermined area based on information read from the first ID reader.

"ID tags," as used herein, means relatively non-intrusive objects that can be permanently or temporarily connected to another object and bearing one or more remotely machine readable code. They can be tags using either RF (Radio Frequency) or optical technology. The wirelessly machine readable code can be embedded in active, semi-passive or passive RFID tags. The optically machine readable code can be read in form of 1-D or 2-D barcode. The tags for the object(s) are paired to a key tag, but they do not have to have the same technology, so long as they are machine readable for input into a computer system and database(s). A key ID tag can be used to enable/disable an alarm for an object ID tag that may be embedded in or attached to a protected object. A target ID stored on the object ID tag is unique and is calculated using source ID on the key ID tag along with a preset algorithm. The key ID tag is protected and cannot be scanned remotely. Further, the source ID is developed so that it cannot be reverse-engineered from target ID, which can be scanned and read without authorization.

"Predefined area," is a geographic area that has managed entry and exit points. Such an area can be a single room with a single point of egress, a multi-room, multi floor structure, or a compound of separate buildings, or for that matter, discontinuous, separate areas that define an effective spatial boundary, such as an airport system wherein the security area for passengers and crew may span states, countries and continents made up of secured passenger areas that effectively extend into airplanes and to other locations. A complex of buildings might have secured buildings, or floors or areas that are not physically contiguous but otherwise connected by a common security area defined by the same or similar security measures, generally defined by access to the same databases of. The predefined area can be dynamic, in that the boundaries can move, such as military camps, etc. Not every entrance or exit need have the same security measures or levels. For instance, at an airport there might be entry points and areas for the general travelling population, and other areas for staff, for crew, for mechanics, etc., each with the same, overlapping or different security measures, as appropriate. A predefined area can be virtually any area that has managed entry and egress to a relevant population.

"Notification state," as used herein means a state in which a notification message is generated that the object target ID is associated with a calculated target ID in the database. The notification message may be provided via a sensory notification that includes an auditory output, such as a loud buzzing noise, an optical output, such as a flashing light, or even a somatic sensory output, such as a tactile feedback from a vibrating device carried by individuals associated with the location where the protected object or objects are kept. The sensory notification may be provided in a public fashion, which alerts all those within a range of the alarm, or it may be provided in a more limited fashion, such that, for example, only those individuals associated with the location where the protected object or objects are kept are notified. The latter may be accomplished in many ways, including for instance with individual vibrating devices carried by staff members, earpieces carried by staff members, or other private alerting systems that may be known by one of ordinary skill in the art.

A method and system for loss prevention is disclosed herein. A plurality of Identification ("ID") tags may be used that include a key ID tag and an object ID tag, which is associated with the key ID tag, that are provided in conjunction with a protected object. The protected object may be any object where it is desired to monitor the location of the object and prevent its removal from one location to another location, such as in a library, retail store, warehouse, or other setting. The ID tags may use Radio Frequency Identification ("RFID") or any other wireless-based technology or may use other technology for identification, such as barcode scanning. Furthermore, the object ID tag may be attached to or embedded in a product, which is for example merchandise sold by a retail store or other type of sales or storage outlet.

The protected object as referred to in this disclosure may refer to an inanimate object, such as an electronic device of which the prevention of theft or movement from one location to another is desired. However, the protected object may also refer to a person. In this sense, the object ID tag may be attached to an article of clothing or other article carried on or with the person. In this sense, the key ID tag and object ID tag may be used in a facility that cares for the infirm or disabled, such as for example a nursing home or elderly care facility. Additionally, the key ID tag and object ID tag may be used in a facility that cares for or watches after children, such as a daycare facility. The key ID tag and object ID tag may also be used in a facility that cares for or watches after pets.

Figure 2:
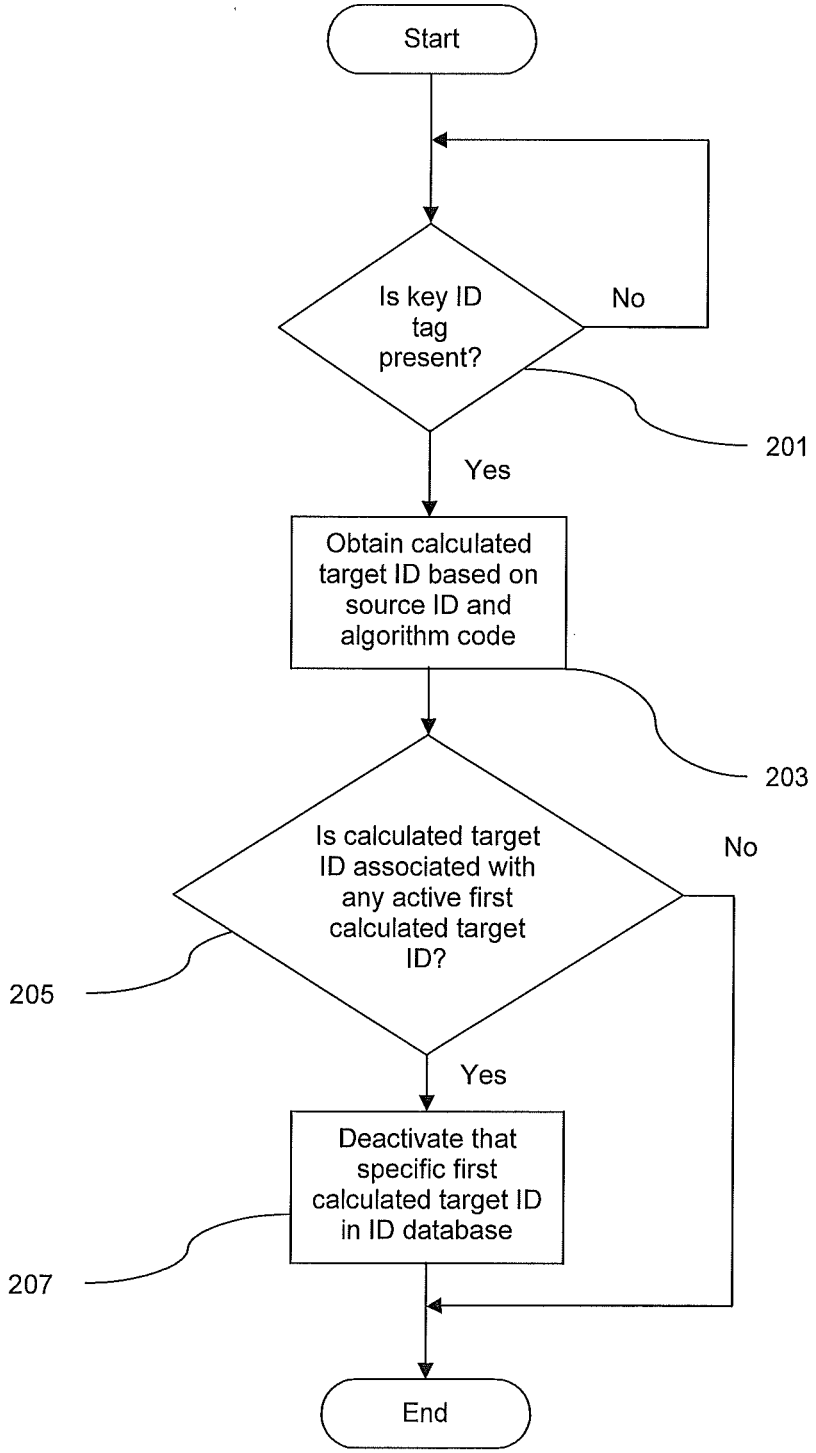
FIG. 2 is a flowchart depicting steps of the preferred embodiment of the present disclosure relating to deregistering the object upon exiting the predetermined area based on information read from the second ID reader.
Figure 3:
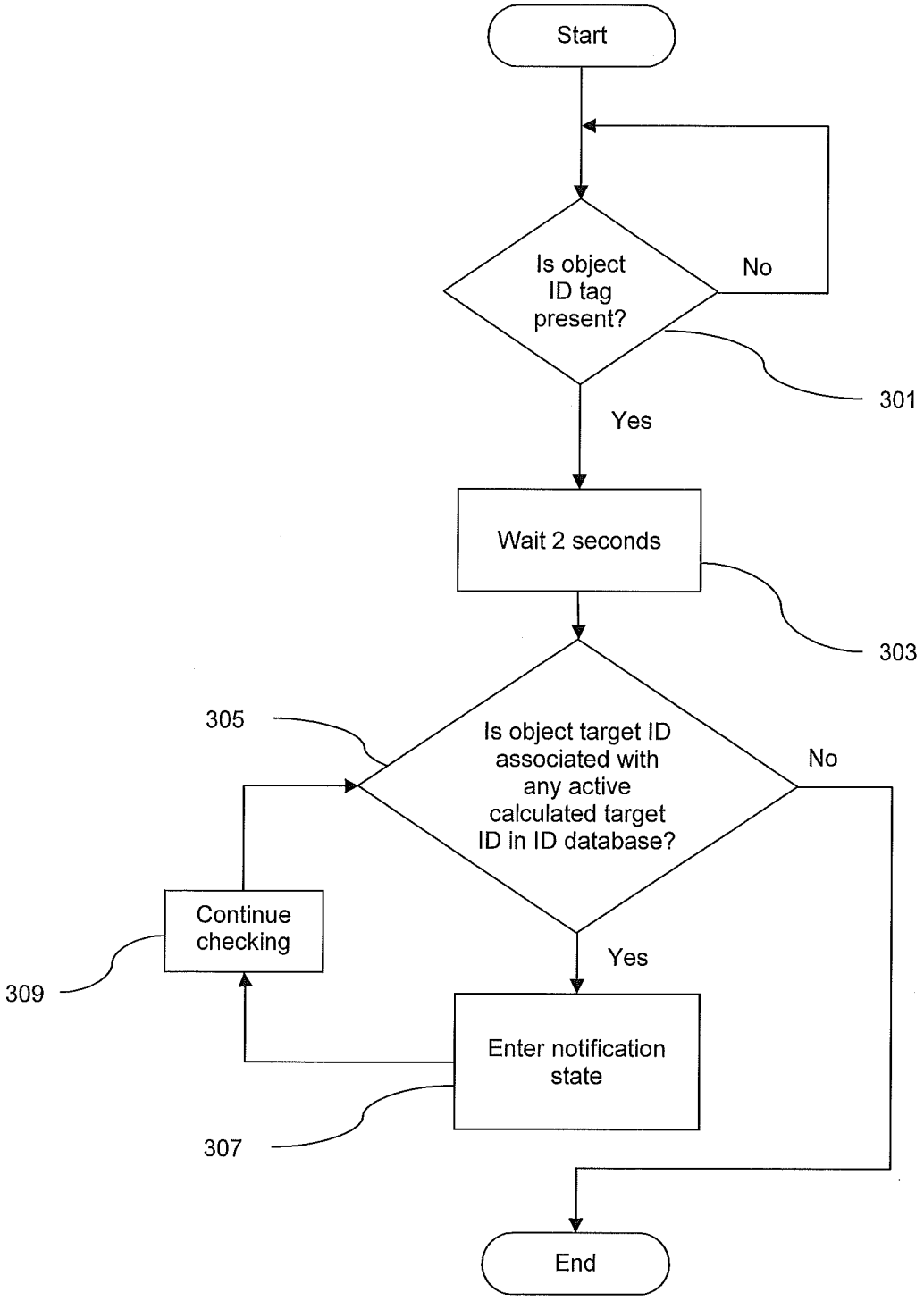
FIG. 3 is a flowchart depicting steps of the preferred embodiment of the present disclosure relating to entering a notification state based on information read from the third ID reader.

Referring to FIGS. 1-3, a preferred embodiment of a method for loss prevention is depicted. FIG. 1 is a flowchart depicting steps of the method that comprises the steps of the first ID reader reading an ID tag of a plurality of ID tags at entrance location, determining a type of the ID tag based on the reading of the ID tag, and upon determining the ID tag that was read is a key ID tag, at 101, a central control system calculating a first calculated target ID based on a source ID and an algorithm code of the key ID tag, at 103. The method further comprises the step of storing the first calculated target ID in ID database, at 105 as an active first calculated target ID. Additionally, the database may comprise more than one database. For instance, the ID database stores calculated target IDs and the algorithm database stores formulas for calculating a target ID.

As shown in the flowchart of FIG. 2, the method may also comprise the steps of the second ID reader reading an ID tag of the plurality of ID tags at exit location, determining a type of ID tag based on the reading of the ID tag at 201, and upon determining the ID tag that was read is the key ID tag, at 201, the central control system calculating a second calculated target ID based on the source ID and the algorithm code of the key ID tag, at 203. The central control system then compares the second calculated target ID to all active first calculated target IDs stored in the ID database, at 205, and upon determining that the second calculated target ID is associated with one of the active first calculated target ID stored in the ID database, the central control system deactivates that specific first calculated target ID in the ID database, at 207. Deactivating the specific first calculated target ID may comprise removing the specific first calculated target ID from the ID database. In an embodiment, deactivating the specific first calculated target ID may comprise flagging the specific first calculated target ID as being inactive in the ID database.

If the central control system determines that the second calculated target ID is not associated with any active first calculated target ID stored in the ID database, then the method ends.

Association between the second calculated target ID and the specific first calculated target ID may be a direct match with a one-to-one correspondence between the values. As will be appreciated by persons skilled in the relevant art, the association between the second calculated target ID and the specific first calculated target ID may be determined using various methods. For instance, the second calculated target ID and the specific first calculated target ID may have to have a predetermined relationship to make the determination that the two values are associated.

The method may further comprise the steps shown in the flowchart of FIG. 3. FIG. 3 shows that the method may include the third ID reader reading an ID tag of a plurality of ID tags at exit location, determining a type of the ID tag based on the reading of the ID tag, and upon determining the ID tag that was read is an object ID tag, at 301, determining an object target ID based on the reading of the object ID tag. The method also includes step 303 of waiting for a predetermined period of time, for instance two seconds, and then comparing the object target ID to all active calculated target IDs stored in the ID database, at step 305, and entering a notification state upon determining the object target ID is associated with one of the calculated target IDs in the ID database, at 307.

Association between the object target ID and the specific first calculated target ID may be a direct match with a one-to-one correspondence between the values. As will be appreciated by persons skilled in the relevant art, the association between the object target ID and the specific first calculated target ID may be determined using various methods. For instance, the object target ID and the specific first calculated target ID may have to have a predetermined relationship to make the determination that the two values are associated.

The central control system may be a stand-alone, self-contained electronic device in a preferred embodiment. In yet another preferred embodiment, the central control system may comprise a computer system with many networked local control units.

It is noted that while the words "first", "second", and "third" may be used to describe a component, the use of these words does not denote a particular order or sequence to the component that is so described.

The object ID tag may comprise an object type identifier that indicates the product to which the object ID tag is attached such that the central control system is able to use a display to display an object type information of the product based on the object type identifier of the object ID tag. The display of the object type information or a generic picture of the product can help a staff member to identify the protected object, which may be an item of merchandise such as a laptop or other electronic device. While the notification state is triggered, the central control system continues to check or monitor the triggering algorithm, at 309. If the object target ID is no longer associated with any active first calculated target ID in the database at some point after the notification state was entered, the central control system stops checking the triggering algorithm and exits the logic, which also exits the notification state. If the object target ID continues to be associated with one of the active calculated target IDs in the ID database, a notification message may be generated.

The method may comprise using a single ID reader to read the ID tags when all tags are wireless-based and entrance and exit are located at same location, or use a different ID reader for each of the separate entrance and egress points in the predetermined area. The central control system determines whether the ID tag read is a key ID tag or an object ID tag. If the ID tag read is a key ID tag, the central control system may further determine whether the key ID tag read is the first instance of that specific key ID tag being read (used to store the calculated target ID in the ID database as an active first calculated target ID) or a second instance of the key ID tag being read (used to deactivate the specific stored first calculated target ID). Furthermore, as discussed, the ID tags may be wireless-based, such as RFID and the associated ID readers are then RFID tag readers. However, in another embodiment if the ID tags are barcode based, an ID reader will be a barcode ID reader or scanner. In an embodiment, the object ID tag may be wireless-based, such as RFID and the associated ID readers are then RFID tag readers, and the Key ID tag may be barcode based, and the associated ID reader will be a barcode ID reader or scanner.

In another preferred embodiment of the method for loss prevention, a person may take a protected object to an area with an access control and alarm system, such as library, with concerns of theft, and this person scans the key ID tag at a first ID reader before entering the area with the protected object. At an entrance location, when the first ID reader reads the ID tag, a central control system decides if this is a key ID tag. If so, the central control system calculates a first calculated target ID based on source ID and algorithm code stored on key ID tag, and saves it to the ID database. If other ID tag types are read, the central control system ignores other ID tag types, read by the ID reader, other than the key ID tag.

At an exit location, a second ID reader reads an ID tag and the central control system decides if this is a key ID tag. If the second ID reader reads a key ID tag, it calculates a second calculated target ID based on source ID and algorithm code on the key ID tag. The central control system then checks if the second calculated target ID is associated with any active first calculated target ID in the ID database. If so, the central control system deactivates that specific first calculated target ID in the ID database. Deactivating the specific first calculated target ID may comprise removing the specific first calculated target ID from the ID database. In an embodiment, deactivating the specific first calculated target ID may comprise flagging the specific first calculated target ID as being inactive in the ID database.

If other ID tag types are read, the central control system ignores other ID tag types, read by the second ID reader, other than the key ID tag. If the first or second ID reader reads a key ID tag with an unidentifiable algorithm code, the central control system may cause a special display, such as a Light Emitting Diode ("LED"), to display on the control panel to indicate that particular status. This issue will likely be encountered with an outdated algorithm database or potential hack.

As discussed above, the first and second ID readers may be integrated into a single ID reader. If the first and second ID readers are integrated into a single ID reader, the central control system may further determine whether the key ID tag read is the first instance of that specific key ID tag being read (used to store the calculated target ID in the ID database as an active first calculated target ID) or a second instance of the key ID tag being read (used to deactivate the specific stored first calculated target ID.

At the exit location, a third ID reader, which may consist of a long range reader (in case of wireless technology being used) designed specifically for reading an object ID tag, reads an ID tag and the central control system decides if this is an object ID tag. If the ID tag read is an object ID tag, the central control system may wait for two seconds, or other predetermined period of time and then checks if the object target ID of the object ID tag is associated with any active calculated target ID in the ID database. If the object ID tag is associated with any active calculated target ID in the ID database, the central control system enters a notification state. An object type may be displayed on a display of central control system to help the staff member or other individual to identify the protected object. When it is in notification state, the central control system still checks the triggering algorithm. If the object target ID of the object ID tag is no longer associated with any active calculated target ID in the ID database, the central control system exits the notification state. When the alarm is activated, it may sound at full volume and there may be a momentary push button for lowering the volume to half. If the staff member enters a pass code on a control panel, the staff member may manually acknowledge and/or exit the notification state.

As discussed above, the ID readers may be integrated into a single ID reader. In an embodiment, the second and third ID readers may be integrated into a single ID reader.

Figure 4:
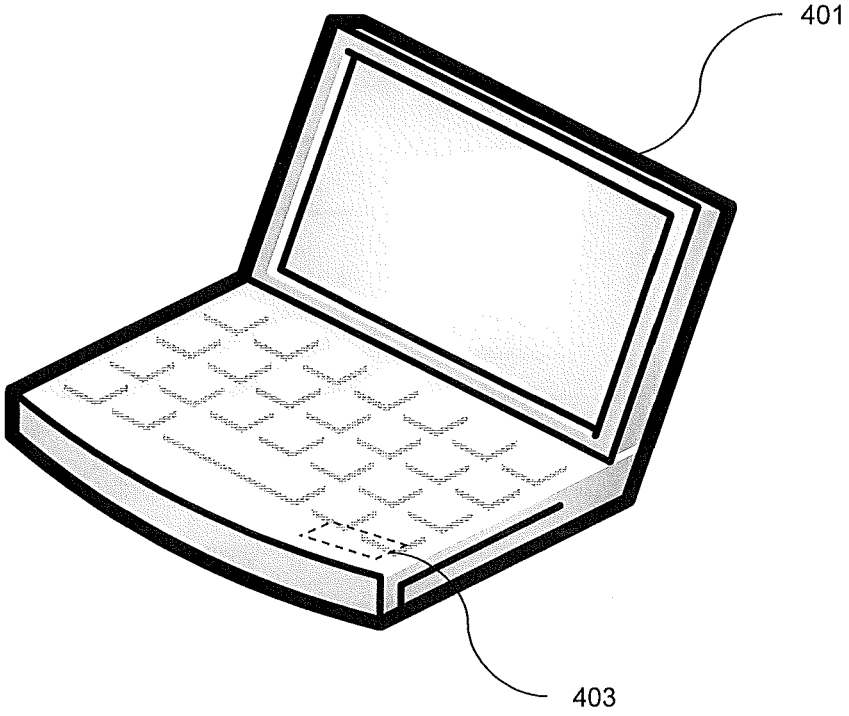
FIG. 4 depicts a product with an object ID tag embedded in accordance with a preferred embodiment of the present disclosure.

As mentioned, the protected product may be an item of consumer merchandise that is manufactured with the object ID tag embedded in or permanently attached to the merchandise. As shown in FIG. 4, the object ID tag 403 may be embedded within a laptop computer 401. A non-exhaustive list of protected objects in which an object ID tag may be embedded, includes but is not limited to:

1. Personal computers, external computer storage or similar devices,
2. Wallet, purse, handbag or similar accessory items,
3. Overcoats, jackets, or similar heavy clothing items,
4. Books, binders or similar,
5. Personal electronic devices such as audio/video player, tablets, mobile phones or similar electronic devices,
6. Children's or elderly's clothing items,
7. Pet accessories or other animal tagging items,
8. Office equipment items, 9. Automobile vehicles, 10. Warehouse inventory items, and 11. Any removable assets of interest.

In a preferred embodiment, the manufacturer of the protected object makes that product with the object ID tag embedded therein or permanently attached thereto, along with the key ID tag associated with the specific object ID tag. A consumer may then purchase the item of merchandise (the protected object) with the object ID tag and key ID tag. In a preferred embodiment using RFID technology, the key ID tag will need to be manufactured such that it is protected and cannot be scanned remotely without authorization. For instance, the key ID tag in an RFID application may implement a Faraday cage, or other mechanism for preventing the scanning of the key ID tag. In another embodiment, for instance, the key ID tag may be provided in a secured housing. In yet another embodiment, the key ID tag may be provided in a handheld device with a retractable or removable metal sleeve or cover. In still another preferred embodiment, the key ID can be displayed in barcode format (1-D or 2-D) on the screen of a mobile device, such as, smart phone or tablet.

In another preferred embodiment a programmable device for key ID tags can be used for integrating multiple key ID tags into one convenient portable device. For example, the programmable device for key ID tags may contain a first and second source ID and first and second algorithm code such that the first source ID and first algorithm code are associated with a first object ID and the second source ID and second algorithm code are associated with a second object ID. Therefore, multiple protected objects, and thus object ID tags, may be associated with a single programmable device for key ID tags. This allows for the elimination of multiple key ID tag devices that may be cumbersome or misplaced.

Figure 5:
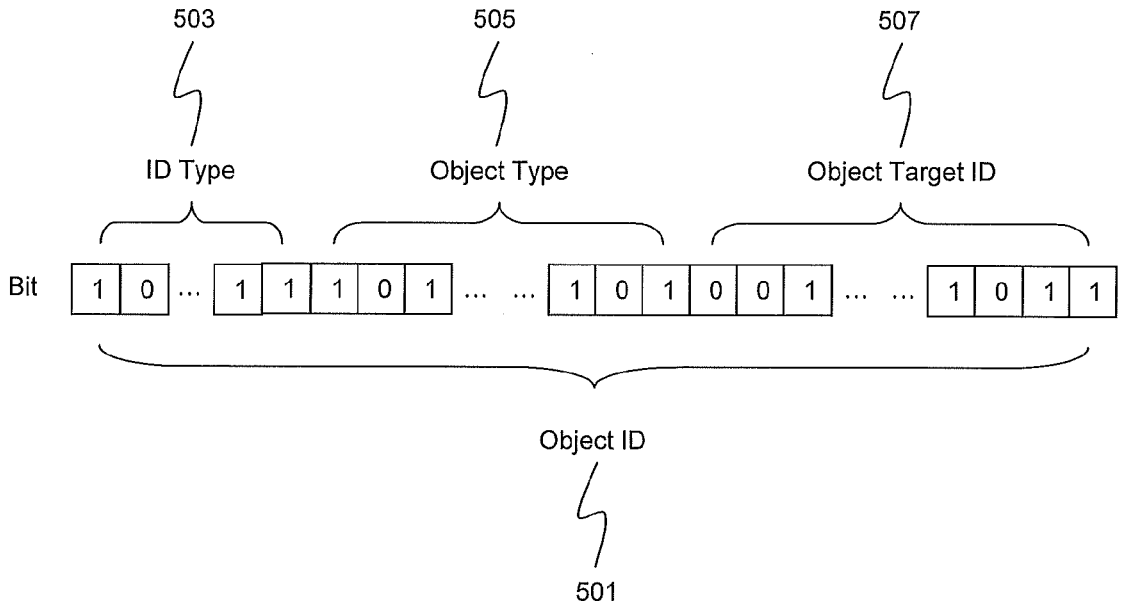
FIG. 5 depicts data structure of object ID of an object ID tag in accordance with a preferred embodiment of the present disclosure.
Figure 6:
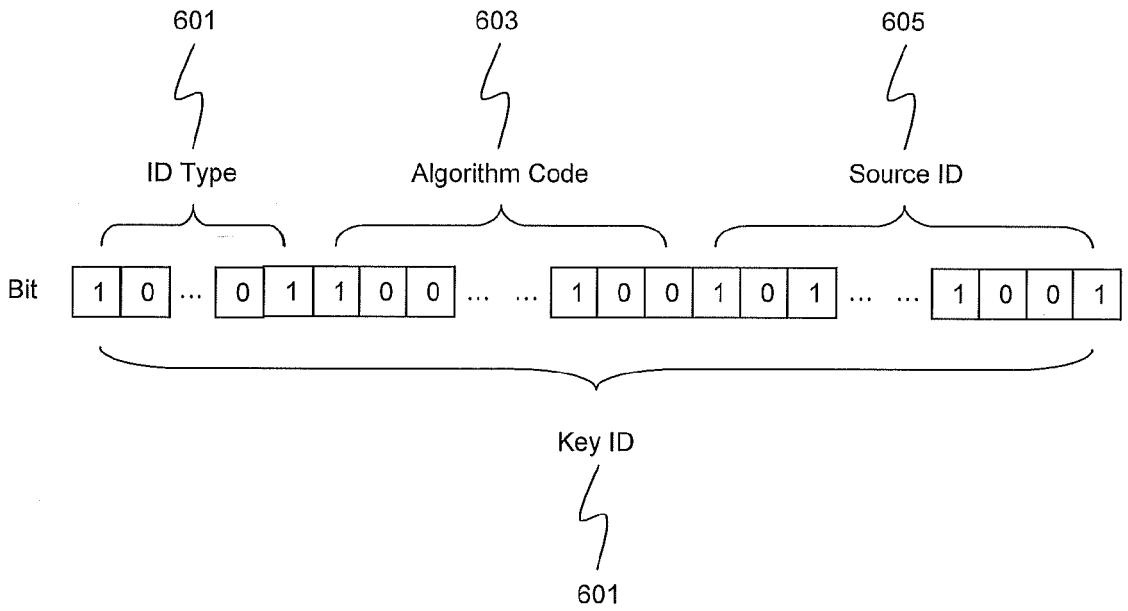
FIG. 6 depicts data structure of key ID of a key ID tag in accordance with a preferred embodiment of the present disclosure.

As shown in FIG. 5, the object ID 501 of an object ID tag may comprise a plurality of bits that includes a first portion of bits 503 corresponding to an ID type for the tag, also called an ID tag type, a second portion of bits 505 corresponding to an object type, and a third portion of bits 507 corresponding to the object target ID. Similarly, as shown in FIG. 6, the key ID 601 of a key ID tag may comprise a plurality of bits and the plurality of bits may include a first portion of bits 603 corresponding to an ID type for the tag, also called an ID tag type, a second portion of bits 605 corresponding to an algorithm code, and a third portion of bits 607 corresponding to a source ID. One or both of the object ID and key ID may include an ID tag type. The ID tag type identifies a particular ID tag as either an object ID tag or a key ID tag. Certain data bit(s) may be reserved for ID tag type information. Further, the central control system may determine whether an ID tag of the plurality of ID tags is the key ID tag or the object ID tag based on a respective ID tag type.

Object type bits are used for identifying what type of object to which the object ID tag is embedded in or attached to. An object target ID is a unique string of data that is preprogrammed. This preprogramming may be done by a manufacturer, a retailer, or some other entity in the supply chain of the protected object or the object ID and key ID tags. Algorithm code may be used for looking up a formula in a database, for instance the algorithm database, to calculate a calculated target ID. Source ID is also used by the central control system to calculate a calculated target ID using preprogrammed formulas. Using algorithm code, instead of the algorithm itself, and source ID allows for the prevention of tampering with the method or system of the present disclosure even if the object ID tag were to be scanned by unauthorized outside source. By only including an algorithm code, rather than a complete algorithm, there would not be a relationship established by scanning an object ID to obtain and reproduce the key ID, which is used to deactivate the active calculated target ID in the ID database. The method and system is able to calculate the proper object target ID from the key ID tag using the appropriate algorithm referenced by the source ID and algorithm code.

Figure 7:
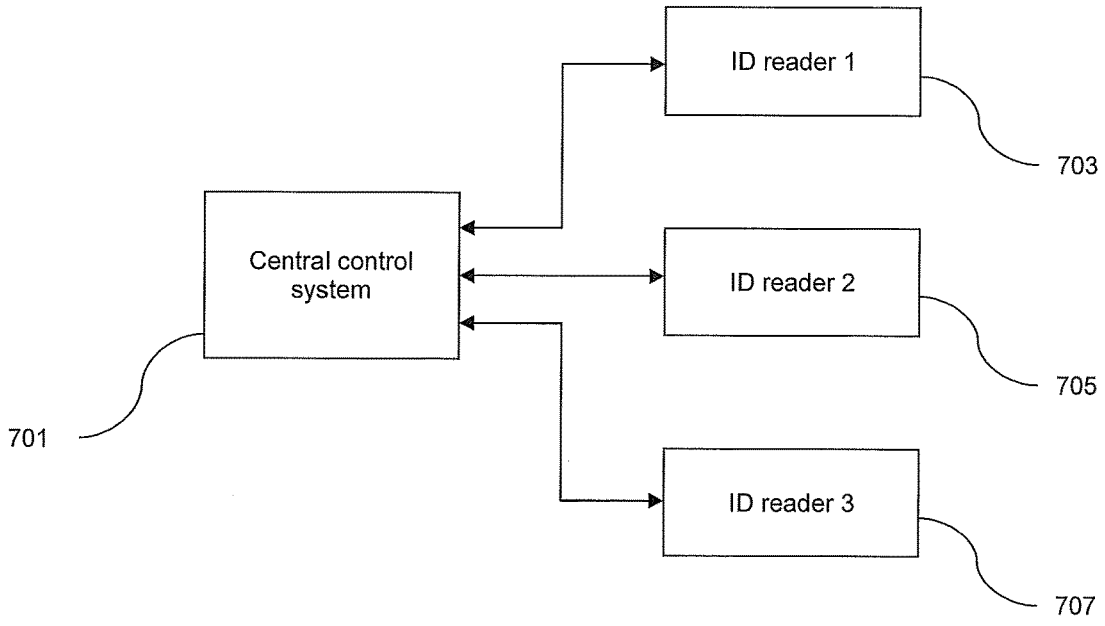
FIG. 7 is an illustration of a central control system, first ID reader, second ID reader, and third ID reader in accordance with a preferred embodiment of the present disclosure.

As shown in FIG. 7, the central control system 701 and the three ID readers 703, 705, 707 may be viewed as an access control and alarm system and may be placed at locations that are appropriate for preventing the unauthorized or undesired movement of a protected object out of a specific area. For example, the first ID reader 703 may be a short-range ID reader for a key ID tag at an entrance to a specific location, the second ID reader 705 may be a short-range ID reader for a key ID tag at an exit to the specific location (e.g. a checkout or safe area), and the third ID reader 707 may be a long-range ID reader for an object ID tag at another exit to the specific location (e.g. the actual exit to the location). Alternately, the second ID reader and third ID reader may be located at the same exit location. All three ID readers are part of, connected to, or in communication with the central control system via a wired or wireless communication network. Alarms (that may be one or both audible and visual) are also part of, connected to, or in communication with the central control system.

Additional ID readers may also be applied for tracking the movement of the key ID tag or object ID tag within a specified location. Other ID readers may also be added to ensure redundancy or to allow for further security measures. For instance, a fourth ID reader may be placed in a zone close to, but not at, an exit to a location so that security measures can be employed prior to the actual exit of a protected object from a specified location. The location of the fourth ID reader may be based on the time it would take an individual to make a hurried escape from the specified location and to allow for security measures to take place to prevent the individual from escaping, such as the locking of doors. Furthermore, as discussed above, all ID readers may be integrated into a single ID reader and the single ID reader may be located at the entrance and the exit simultaneously in the case that they are at the same location, such as in a retail store or library having an entrance and exit for customers through the same set(s) of doors.

Figure 8:
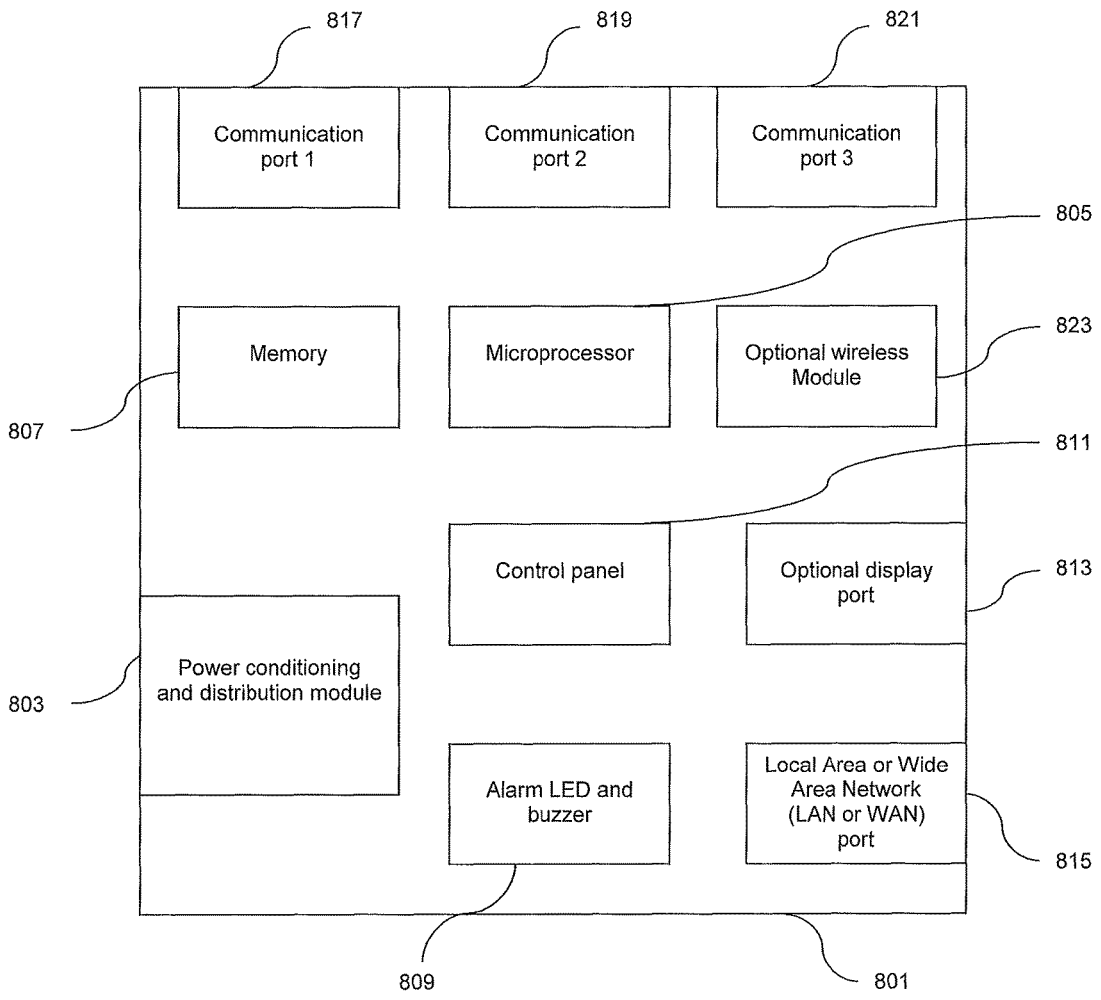
FIG. 8 is an illustration of a central control system in accordance with a preferred embodiment of the present disclosure.

As shown in FIG. 8, the central control system 801 may contain at least one of a power conditioning and distribution unit 803, a microprocessor 805, a memory 807, an alarm LED and buzzer 809, a control panel 811, a display port 813 for connecting a display, a local area network or wide area network (LAN or WAN) port(s) 815, and networking connectivity and communication ports 817, 819, 821 for the ID readers (or wireless communication module 823 for wireless readers). All of the units, modules, ports, etc. of the central control system 801 are connected in a conventional manner as understood by one of ordinary skill in the art. Further, the central control system 801 may have two databases (not shown): an ID database and an algorithm database. The ID database stores calculated target IDs. The algorithm database stores formulas of how the calculated target IDs are calculated. Each formula stored in the algorithm database is unique and has its own algorithm code. The algorithm database may be able to be updated via a programming device either locally or remotely. The databases may be saved to non-volatile memory such that a power loss won't erase or wipe out databases.

The control panel 811 of the central control system 801 may be in a location that is accessible to an individual such as a staff member for the location. The control panel 811 may be configured to allow for the manual input of control commands or other instructions. The control panel 811 may be a panel with physical buttons, switches, dials, or other input structures, or the control panel 811 may be a touch-screen that is reconfigurable. This may also allow a staff member to perform actions for controlling the alarm state, such as disarming the alarm. For example, when an alarm buzzer goes off, it may sound at full volume and a staff member may rely on a push button for lowering the volume or intensity of the alarm. If the staff member enters a pass code on the control panel, the staff member may then manually disarm the alarm.

The ID readers can be connected to the central control system via either serial or Ethernet communication lines. In either case, those communication lines can be either wired or wireless.

Furthermore, the central control system can be centrally located to manage ID validation and storage and alarm notification functions for one or more locations. The central control system communicates with local control units via network (LAN or WAN). This may enable global object ID tag arming and may eliminate the need for updating the algorithm database at individual unit level. In this scenario, the networked central control system and local control unit are used to perform the tasks of a central control system in a standalone setting. All ID readers are connected to the local control unit. Multiple local control units can be connected to the networked central control system.

Figure 9:
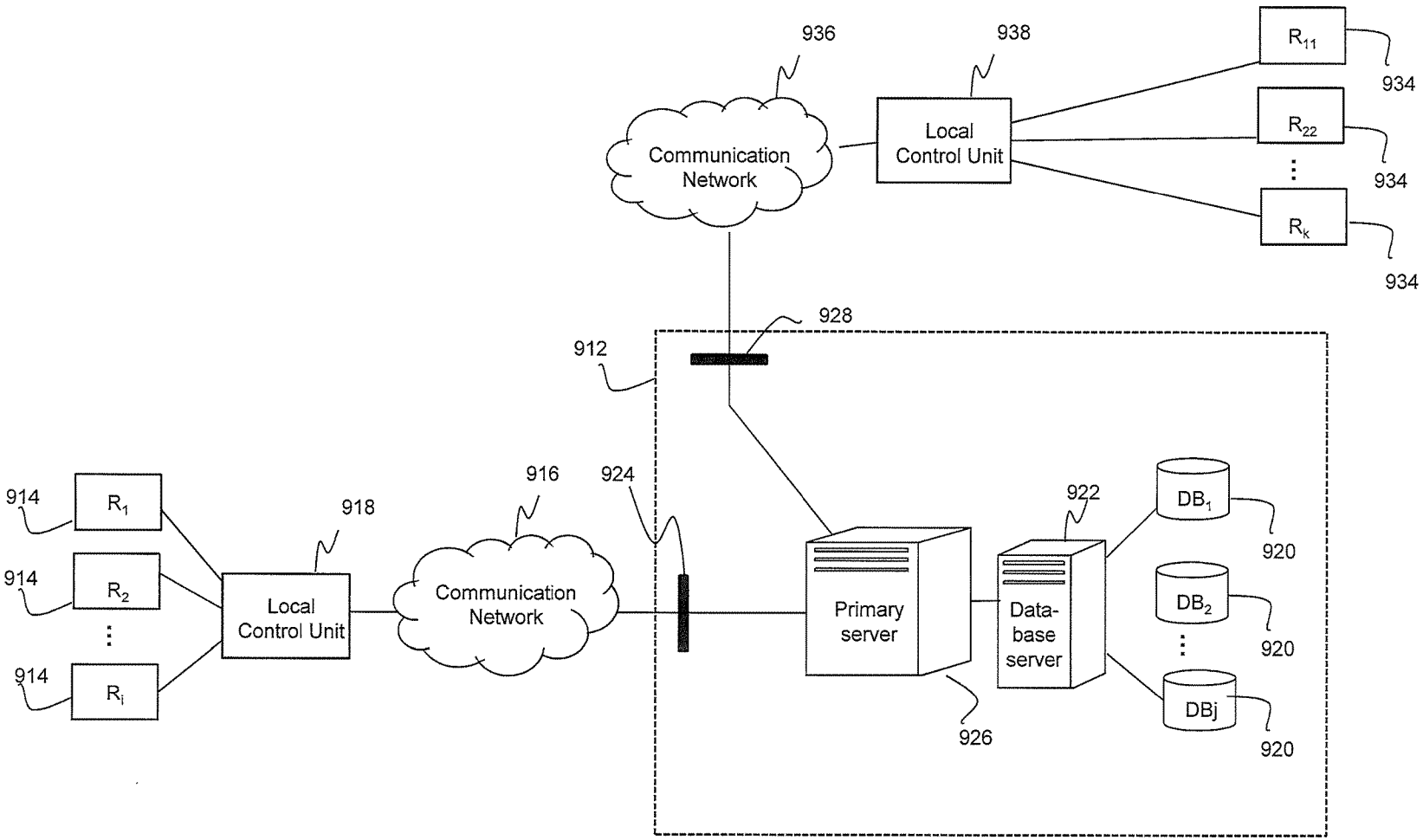
FIG. 9 illustrates a network architecture for various embodiments of the present disclosure.

FIG. 9 illustrates network architecture for carrying out the method and system for loss prevention described above. In the embodiment shown in FIG. 9, the networked central control system 912 is in communication with one or more ID readers $R_1$, $R_2$ . . . $R_i$ 914 (hereinafter referred to as "ID reader 914") via a communications network 916 and a local control unit 918 (similar to 801). The communications network 916 may be the Internet, although it will be appreciated that any public or private communication network, using wired or wireless channels, suitable for enabling the electronic exchange of information between the ID reader 914 and the networked central control system 912 may be utilized. Firewall 924 may be installed between the networked central control system 912 and the communication network 916 to prevent unauthorized access.

The networked central control system 912 may be implemented by any entity that desire to prevent theft, loss, or the movement of items to an undesired location, including but not limited to inventory entities. The networked central control system 912 is configured to provide loss prevention features in conjunction with the use of the local control unit 918. The local control unit 918 may include any suitable network-enabled devices configured to transmit and receive information via the communications network 916 using wired or wireless connections. The ID reader 914 may be configured to connect to the local control unit 918 via wired or wireless communication network. Further, the networked central control system 912 may be in communication with a second set of local control unit 938, which connects to ID readers $R_{11}$, $R_{22}$ . . . $R_k$ 934 (hereinafter referred to as "ID reader 934") via a communications network 936. The local control unit 938, along with the ID reader 934 may be located in the same building or structure as local control unit 918 and ID reader 914 or may be located at a different building, structure, or even location, and still be in communication with the networked central control system 912. In one preferred embodiment, the networked central control system 912 communicates with multiple local control units (918, 938, etc.) in airports, which spans across city, state, even country boundaries, yet still considered as one security area. Firewall 928 may be installed between the networked central control system 912 and the communication network 936 to prevent unauthorized access.

In some embodiments, the networked central control system 912 may be based on multi-tiered network architecture, and includes a primary server 926 and a database server 922. The database server 922 manages one or more databases $DB_1$, $DB_2$ . . . $DB_i$ 920 (hereinafter referred to as "databases 920") which store data to support one or more applications hosted by the primary server 926 or elsewhere. Such databases may include, for example, an ID database and an algorithm database as discussed above, as well as databases for storing other settings and/or configuration data. Database information requested by a particular application is retrieved from the databases 920 directly by server 926 or by the database server 922. The information may then be communicated to a requesting application, and updated by the server 926 or the database server 922 as needed.

The networked central control system may be suitable for security area with legitimate ways of exiting other than traditional exit doors, such as airports, bus, train stations or other transit hubs. The object being armed at one location will be watched at all security areas registered on the networked central control system. Also, it adds another layer of security because the object is removed from one security area without proper authentication will be caught by alarm system of another security area.

As would be appreciated by one of ordinary skill in the relevant art(s) and described below with reference to FIG. 10, the central control system of the methods and systems discussed herein may be distributed as an article of manufacture that itself comprises a computer readable medium (e.g. a non-transitory computer readable medium) having computer readable code means embodied thereon.

The computer readable program code means is operable, in conjunction with a computer system, to carry out the steps to perform the methods or can be used to create the central control system discussed herein. The computer readable medium may be a recordable medium (e.g., hard drives, compact disks, EEPROMs, memory cards, etc.). Any tangible medium known or developed that can store information suitable for use with a computer system may be used. The computer-readable code means is any mechanism for allowing a computer to read instructions and data, such as, for example, magnetic variations on a magnetic media or optical characteristic variations on the surface of a compact disk. The medium can be distributed on multiple physical devices (or over multiple networks). For example, one device could be a physical memory media associated with a terminal and another device could be a physical memory media associated with a processing center.

The computer system(s) and/or server(s) described herein each contain a memory that will configure associated processors to implement the methods, steps, and functions disclosed herein. The memories could be distributed or local and the processors could be distributed or singular. The memories could be implemented as an electrical, magnetic or optical memory, or any combination of these or other types of storage devices. Moreover, the term "memory" should be construed broadly enough to encompass any information able to be read from or written to an address in the addressable space accessed by an associated processor.

Figure 10:
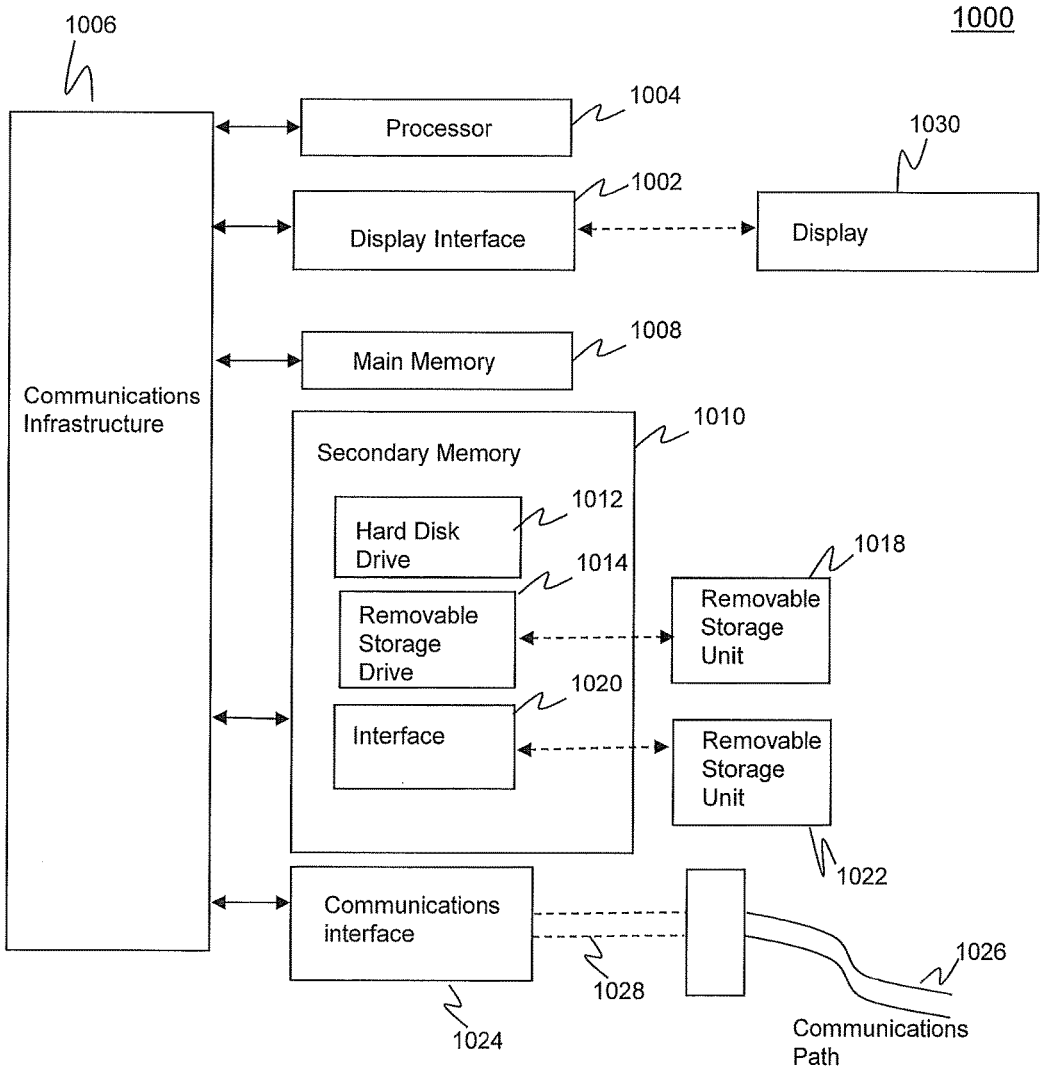
FIG. 10 depicts an example computer system in which embodiments of the present disclosure may be implemented.

Aspects of the central control system described herein and shown in FIGS. 8-10, or any part(s) or function(s) thereof, may be implemented using hardware, software modules, firmware, tangible computer readable media having instructions stored thereon, or a combination thereof and may be implemented in one or more computer systems or other processing systems.

FIG. 10 illustrates an exemplary computer system 1000 in which embodiments of the present disclosure, or portions thereof, including but not limited to the central control system, may be implemented as computer-readable code. For example, the various aspects of the central control system can be implemented in computer system 1000 using hardware, software, firmware, non-transitory computer readable media having instructions stored thereon, or a combination thereof, and may be implemented in one or more computer systems or other processing systems. Hardware, software, or any combination of such may embody any of the modules and components used to implement the central control system described above.

If programmable logic is used, such logic may execute on a commercially available processing platform or a special purpose device. One of ordinary skill in the art may appreciate that embodiments of the disclosed subject matter can be practiced with various computer system configurations, including, but not limited to, multi-core multiprocessor systems, minicomputers, mainframe computers, computers linked or clustered with distributed functions, as well as pervasive or miniature computers that may be embedded into virtually any device. For instance, at least one processor device and a memory may be used to implement the above described embodiments. A processor device may be a single processor, a plurality of processors, or combinations thereof. Processor devices may have one or more processor cores.

Various embodiments of the present disclosure are described in terms of the exemplary computer system 1000. After reading this description, it will become apparent to a person skilled in the relevant art how to implement the central control system of the present disclosure using other computer systems and/or computer architectures. Although operations may be described as a sequential process, some of the operations may in fact be performed in parallel, concurrently, and/or in a distributed environment, and with program code stored locally or remotely for access by single or multi-processor machines. In addition, in some embodiments the order of operations may be rearranged without departing from the spirit of the disclosed subject matter.

The computer system 1000 includes a display 1030 connected to a communications infrastructure 1006 via a display interface 1002. In an embodiment, the display 1030, in conjunction with the display interface 1002, provides a User Interface ("UI") (not shown). The computer system 1000 also includes a processor device 1004 connected to the communications infrastructure 1006. The processor device 1004 may be a special purpose or a general purpose processor device. As will be appreciated by persons skilled in the relevant art, the processor device 1004 may also be a single processor in a multi-core/multiprocessor system, such system operating alone, or in a cluster of computing devices operating in a cluster or server farm. Processor device 1004 is connected to the communication infrastructure 1006, for example, via a bus, a message queue, a network, a multi-core message-passing scheme, etc.

The computer system 1000 also includes a main memory 1008, for example, a random access memory (RAM), and may also include a secondary memory 1010. The secondary memory 1010 may include, for example, a hard disk drive 1012 and a removable storage drive 1014. The removable storage drive 1014 may comprise a floppy disk drive, a magnetic tape drive, an optical disk drive, a flash memory, or the like.

The removable storage drive 1014 may read from and/or write to a removable storage unit 1018 in a well-known manner. The removable storage unit 1018 may comprise a floppy disk, magnetic tape, optical disk, Universal Serial Bus (USB) drive, flash drive, memory stick, etc., which is read by and written to by removable storage drive 1014. As will be appreciated by persons skilled in the relevant art, the removable storage unit 1018 may include a non-transitory computer usable storage medium having stored therein computer software and/or data.

In alternative implementations, the secondary memory 1010 may include other similar means for allowing computer programs or other instructions to be loaded into the computer system 1000. Such means may include, for example, a removable storage unit 1022 and an interface 1020 provided within, for example, the secondary memory 1010. Examples of such means may include, but are not limited to, a program cartridge and cartridge interface (such as that found in video game devices), a removable memory chip (such as an EPROM or PROM) and associated socket, and other removable storage units 1022 and interfaces 1020 which allow software and data to be transferred from the removable storage unit 1022 to the computer system 1000.

The computer system 1000 may also include a communications interface 1024. The communications interface 1024 allows software and data to be transferred between the computer system 1000 and external devices. The communications interface 1024 may include a modem, a network interface (such as an Ethernet card), a communications port, a PCMCIA slot and card, or the like. Software and data transferred via the communications interface 1024 may be in the form of signals 1028, which may be electronic, electromagnetic, optical, or other signals capable of being received by communications interface 1024. These signals may be provided to the communications interface 1024 via a communications path 1026. The communications path 1026 carries signals and may be implemented using wire or cable, fiber optics, a phone line, a cellular/wireless phone link, an RF link, or other communications channels.

In this document, the terms "computer program medium", "non-transitory computer readable medium", and "computer usable medium" are used to generally refer to tangible media such as, for example, removable storage unit 1018, removable storage unit 1022, and a hard disk installed in hard disk drive 1012. Signals 1028 carried over the communications path 1026 can also embody the logic described herein. The computer program medium and computer usable medium can also refer to memories, such as, for example, main memory 1008 and secondary memory 1010, which can be memory semiconductors (e.g., DRAMs, etc.). These computer program products are means for providing software to computer system 1000.

Computer programs (also called computer control logic and software) are generally stored in the main memory 1008 and/or the secondary memory 1010. The computer programs may also be received via the communications interface 1024. Such computer programs, when executed, enable the computer system 1000 to become a specific purpose computer able to implement the present disclosure as discussed herein. In particular, the computer programs, when executed, enable the processor device 1004 to implement the processes of the present disclosure discussed below. Accordingly, such computer programs represent controllers of the computer system 1000. Where the present disclosure is implemented using software, the software may be stored in a computer program product and loaded into the computer system 1000 using, for example, the removable storage drive 1014, interface 1020, and hard disk drive 1012, or communications interface 1024.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

Embodiments of the present invention have been described above with the aid of functional building blocks illustrating the implementation of specified functions and relationships thereof. The boundaries and order of these functional building blocks have been arbitrarily defined herein for the convenience of the description. Alternate boundaries and order of steps can be defined so long as the specified functions and relationships thereof are appropriately performed.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

Although the disclosure is illustrated and described herein with reference to specific embodiments, the embodiments are not intended to be limited to the details shown. Rather, various modifications may be made in the details within the scope and range equivalents of the claims and without departing from the disclosure.

I claim:

1. A method of loss prevention of an object from a predetermined area comprising:

reading a key ID tag at an entrance of the predetermined area bearing a source ID and an algorithm code, wherein the algorithm code identifies an algorithm for calculating a target ID from an algorithm database;

calculating, by a central control system, a first calculated target ID based on the source ID in accordance with the algorithm identified by the algorithm code of the key ID tag;

storing the first calculated target ID in a database as an active first calculated target ID;

reading an object ID tag having an object target ID at an exit of the predetermined area;

the entrance and the exit to the predetermined area being an identical location or at least two different locations within the predetermined area;

comparing, by the central control system, the object target ID to all active calculated target IDs stored in the database; and upon determining the object target ID is associated with an active calculated target ID in the database, entering a notification state.

2. The method of claim 1, further comprising:

reading the key ID tag at the exit of the predetermined area;

calculating, by the central control system, a second calculated target ID based on the source ID and the algorithm code of the key ID tag;

comparing, by the central control system, the second calculated target ID to all active first calculated target IDs stored in the database; and deactivating that specific first calculated target ID in the database upon determining that the second calculated target ID is associated with one of the active first calculated target IDs stored in the database.

3. The method of claim 2, wherein deactivating the specific first calculated target ID in the database may include removing the specific first calculated target ID from the database or flagging the specific first calculated target ID as being inactive.

4. The method of claim 1, further comprising manufacturing a product with the object ID tag embedded in the product or attaching the object ID tag to a product.

5. The method of claim 1, further comprising:

a first ID reader located at the entrance, a second ID reader located at the exit, and a third ID reader located at the exit.

6. The method of claim 5, wherein the first ID reader is a first Radio Frequency ID ("RFID") or barcode reader, the second ID reader is a second RFID or barcode reader, and the third ID reader is a third RFID or barcode reader.

7. The method of claim 1, wherein the key ID tag is in a secured housing that shields the source ID and the algorithm code from being read without authorization.

8. The method of claim 1, wherein the object ID tag further comprises an ID tag type and the key ID tag further comprises an ID tag type, the method further comprising determining, via the central control system, whether an ID tag of the plurality of ID tags is the key ID tag or the object ID tag based on a respective ID tag type.

9. The method of claim 1, wherein the database comprises an ID database that stores calculated target IDs and the algorithm database that stores formulas for calculating a target ID.

10. The method of claim 1, wherein the object ID of an object ID tag further comprises an object type identifier and further comprising displaying an object type information based on the object type identifier on a display unit.

11. The method of claim 1, further comprising exiting the notification state upon determining that the object target ID is no longer associated with any of the active calculated target ID in the ID database.

12. The method of claim 1, further comprising manually acknowledging and/or exiting the notification state via a control panel of the central control system.

13. The method of claim 1, wherein the key ID tag is capable of storing a plurality of source IDs and a plurality of algorithm codes associated with the plurality of object ID tags.

14. The method of claim 1, wherein the key ID of a key ID tag comprises a plurality of bits, wherein the plurality of bits comprises a first portion of bits corresponding to an ID type, a second portion of bits corresponding to the algorithm code, and a third portion of bits corresponding to the source ID.

15. The method of claim 1, wherein the object ID of an object ID tag comprises a plurality of bits, wherein the plurality of bits comprises a first portion of bits corresponding to an ID type, a second portion of bits corresponding to an object type, and a third portion of bits corresponding to the object target ID.

16. A system for detecting an object in a predetermined area comprising:

a plurality of ID tags comprising the object ID of an object ID tag bearing an object target ID and the key ID of a key ID tag bearing a source ID and an algorithm code, wherein the algorithm code identifies an algorithm for calculating a target ID from an algorithm database;

at least one ID reader at an entrance of the predetermined area; and a central control system having a processor and in communication with the at least one ID reader, the central control system being associated with ID database; and wherein the at least one ID reader reads an ID tag of the plurality of ID tags; and upon a determination by the central control system that the ID tag that was read by the at least one ID reader is the key ID tag, the central control system calculates a first calculated target ID based on the source ID in accordance with the algorithm identified by the algorithm code of the key ID tag; and wherein the central control system stores the first calculated target ID in the ID database as an active first calculated target ID; and wherein the at least one ID reader reads the object target ID of the object ID tag at an exit of the predetermined area; the entrance and the exit to the predetermined area being an identical location or two different locations within the predetermined area; and wherein the central control system compares the object target ID read by the at least one ID reader to all active calculated target IDs stored in the ID database; and upon a determination by the central control system that the object target ID read by the at least one ID reader is associated with one of the active calculated target IDs in the ID database, the central control system enters a notification state.

17. The system of claim 16, wherein the at least one ID reader reads an ID tag of the plurality of ID tags; and upon a determination by the central control system that the ID tag that was read by the at least one ID reader is the key ID tag, the central control system calculates a second calculated target ID based on the source ID and the algorithm code of the key ID tag; and wherein the central control system compares the second calculated target ID to all active first calculated target IDs stored in the ID database; and upon a determination by the central control system that the second calculated target ID is associated with one of the active first calculated target IDs stored in the ID database, the central control system deactivates that specific first calculated target ID in the ID database.

18. The system of claim 17, wherein deactivating the specific first calculated target ID in the ID database may include removing the specific first calculated target ID from the ID database or flagging the specific first calculated target ID as being inactive.

19. The system of claim 16, wherein the product is merchandise manufactured by a manufacturer, and wherein the merchandise is manufactured with the object ID tag embedded in the merchandise or with the object ID tag attached to the merchandise.

20. The system of claim 16, wherein the object ID of an object ID tag further comprises an object type identifier and wherein the central control system uses a display to display an object type information based on the object type identifier.

21. The system of claim 16, further comprising a control panel, wherein the control panel is configured to allow for the manual acknowledgement and/or exit of the notification state.

* * * * *